United States Patent [19]

Stetson

[11] 4,051,982

[45] Oct. 4, 1977

[54] FAST RELEASE AERATOR FOR MATERIALS HANDLING

[75] Inventor: Harold M. Stetson, Neponset, Ill.

[73] Assignee: Martin Engineering Company, Neponset, Ill.

[21] Appl. No.: 727,397

[22] Filed: Sept. 29, 1976

Related U.S. Application Data

[63] Continuation-in-part of Ser. No. 502,547, Sept. 9, 1974, abandoned.

[51] Int. Cl.[2] ..... G05D 3/14; B67B 7/24

[52] U.S. Cl. ..... 222/195; 222/3; 137/102

[58] Field of Search ..... 222/3, 4, 399, 195, 222/5; 137/102; 251/361

[56] References Cited

U.S. PATENT DOCUMENTS

| | | | |
|---|---|---|---|
| 2,716,997 | 9/1955 | Crookston | 137/102 |
| 3,788,527 | 1/1974 | Matson | 222/195 |

*Primary Examiner*—Stanley H. Tollberg
*Assistant Examiner*—Hadd Lane
*Attorney, Agent, or Firm*—McWilliams & Mann

[57] ABSTRACT

A unit for transferring a charge of air under pressure from a reservoir or accumulator to a container of dispensable or flowable material of granular or like nature. The unit is in the form of a hollow body having at one end a flange for connection to the reservoir, at its other end an inlet for receiving air under pressure, at one side a flange for connection to the container and an interior piston-valve operative first to enable charging of the reservoir with a large volume of air under pressure and second to release the reservoir air rapidly into the container.

2 Claims, 7 Drawing Figures

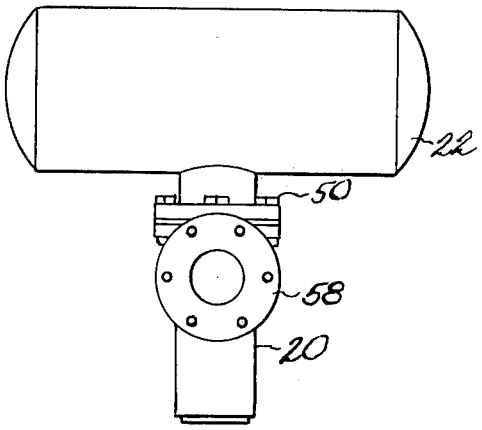
FIG. 1
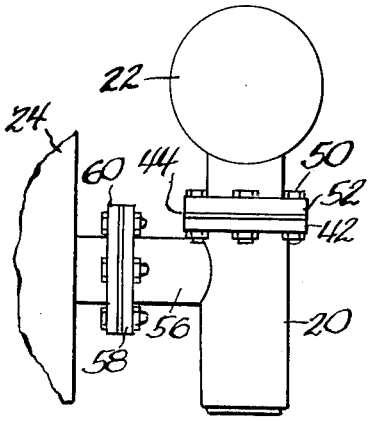
FIG. 2
FIG. 3
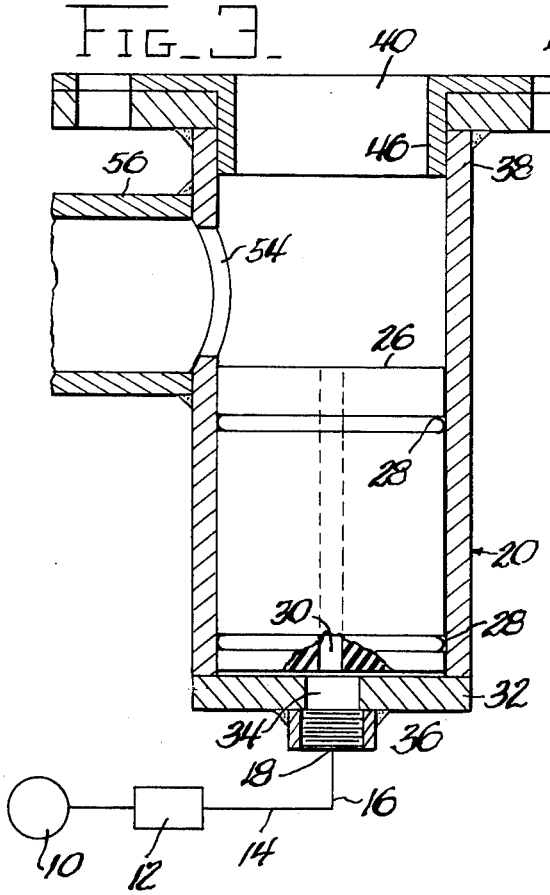
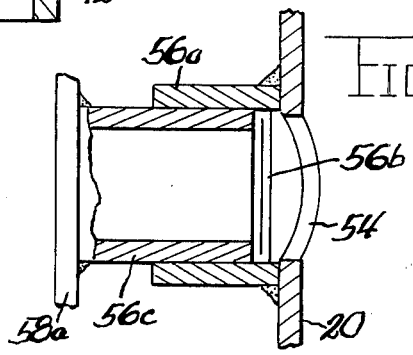
FIG. 4
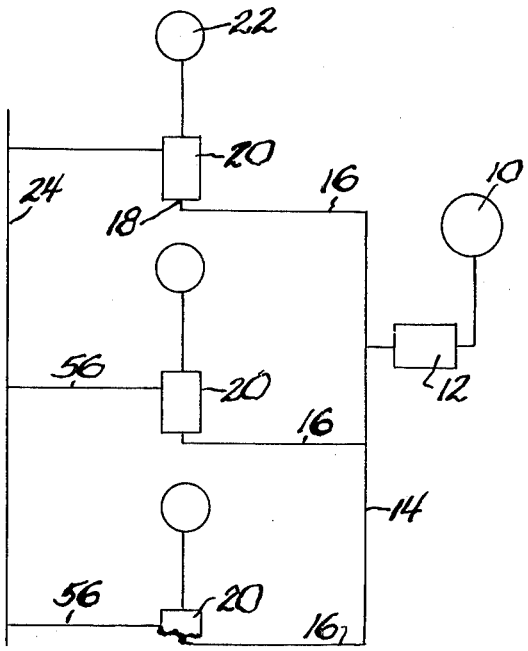
FIG. 5

FAST RELEASE AERATOR FOR MATERIALS HANDLING

BACKGROUND OF THE INVENTION

This application is a continuation-in-part of my copending application Ser. No. 502,547 filed Sept. 9, 1974, now abandoned.

At least one form of aerator for the above purposes has been patented and is the subject matter of assignee's U.S. Pat. No. 3,788,527 to Matson. Aerators of this type find particular utility in starting and facilitating the movement of granular and like materials stored or contained in bins, silos, elevators, hoppers, conveyors and the like, the purpose of the aerator being to store a large volume of air under pressure and then to release it into the bin etc., producing the equivalent of a dull "explosion" that acts on even the most stubborn material.

SUMMARY OF THE INVENTION

In the Matson patented aerator, the main chamber or body becomes integrated with the reservoir at its attachment to a container or like vessel as via welding. According to the present invention, there is provided a unit body containing the piston valve and flange-connectible to each of the reservoir and container, thus making installation easy and enabling the use of several units with one or more reservoirs or one or more containers. The piston is movable initially by air under pressure to a position in which it covers the side discharge port, and the piston has a passage axially therethrough by means of which inlet air can flow to charge the reservoirs. When the valve admitting air to the inlet of the unit body is closed, the air trapped between that valve and the piston valve keeps the piston in its charging position and reservoir air is stored, because it cannot flow to the container. When the control valve is moved to allow the trapped air to escape to atmosphere, the piston valve returns rapidly to its position in which it uncovers the discharge port and at the same time widely opens the reservoir charge port, resulting in a rush of stored air into the container.

The piston valve may be inexpensively made of nonmetallic material, thus providing longer life. The flange connection to the reservoir may include a spacer incorporating a piston stop or seat that may be easily replaced. The passage through the piston valve eliminates costly and complicated valving.

DESCRIPTION OF THE DRAWINGS

FIG. 1 is an elevation of the assembly of unit, reservoir and container, only a portion of the container being shown.

FIG. 2 is a view of the FIG. 1 structure as seen at right angles to FIG. 1.

FIG. 3 is an enlarged vertical section through the charge unit or body of FIG. 1.

FIG. 4 is a partial sectional view of a modified form of the structure shown in FIG. 3.

FIG. 5 is a diagrammatic view illustrating but one of may circuits in which the invention may be incorporated.

DESCRIPTION OF PREFERRED EMBODIMENTS OF THE INVENTION

Figure 6:
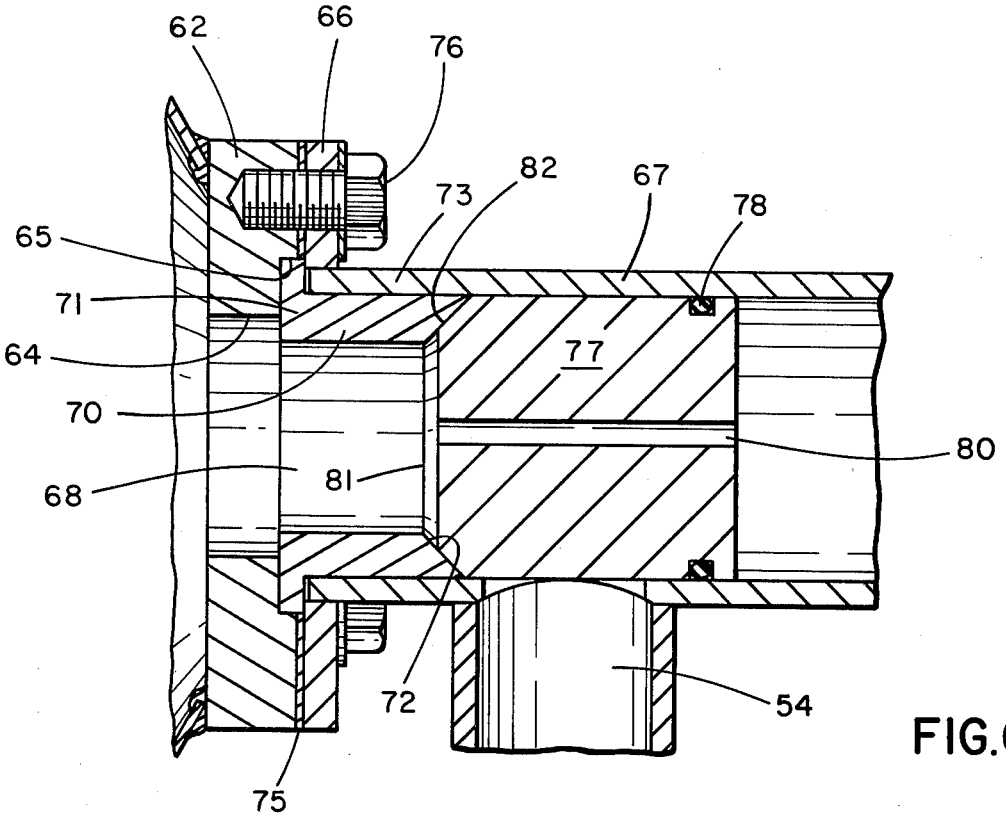
FIG. 6 is a sectional view of a modified embodiment of a portion of the structure shown in FIG. 3.

Reference will be had first to FIG. 5 as presenting an overall picture. Here is shown at 10 an air compressor of known type connected via a typical three-way valve 12 to a supply circuit 14 having three branches 16, each connected to the inlet end 18 of a charge unit or body 20. Each body is selectively connectible to a reservoir or accumulator 22 and to a container, vessel or the like 24.

FIG. 3 best shows the basic and interior structure of the unit or body 20, which is preferably cylindrical and tubular or hollow to contain a piston or piston valve 26 of any suitable material, although preferably non-metallic for longer life, ease of manufacture, etc. The piston carries two air-tight seals, such as "O" rings 28, and has a relatively small axial passage 30 running end-to-end therethrough.

The body 20 is capped at one end by a circular plate 32 welded or otherwise rigidly affixed to the body, and this plate is centrally apertured at 34 in axial alinement with the piston outside of the plate 32 and is internally threaded to receive any conventional mating fitting (not shown) for effecting connection to the supply branch or line 16.

The opposite end of the body 20 may be referred to as the charge end, indicated at 38, and is open to provide a charge port 40. A circular or annular flange 42 is disposed radially to the axis of the body 20 and is welded to the body in surrounding relation to the charge port. An annular spacing member 44 overlies the outer (here top) surface of the flange 42 and incorporates a piston stop or seat 46 of tubular form which fits and depends into the charge end 38 and only slightly reduces the size of the charge port 40. The flange and spacer member are suitably apertured at 48 in circumferentially spaced relation to accommodate bolts 50 for attachment to a matching flange 52 on the reservoir 22. At this point it should be noted that, although the main axis of the body 20 is shown as vertical, the body may be otherwise oriented and the particular illustration does not constitute a limitation on the invention.

When the piston 26 is in its discharge position as shown in FIG. 3, it uncovers a discharge port formed in a portion of the side wall of the body 20. In a form of the invention, as shown particularly in FIGS. 2 and 3, there is welded to the side of the body in coaxial or registering relation to the discharge port 54 a tubular part 56 to the outer end of which is welded a flange 58 very much like the flange 42. The flange 58 is suitably and removably connected to a matching flange 60 on the container 24 as shown in FIG. 2.

As shown in FIG. 4, the tubular part 56 may be replaced by a welded-on tubular part 56a, which is internally threaded at 56b to receive an externally threaded second tubular part 56c which has welded to its outer end a flange 58a very much like the flange 58. This design has the advantage that parts, like 56c, of diameters different from that of the part 56, may be used to vary the size of the discharge to the container.

As those familiar with the art know, the valve 12 has three positions, one in which the compressor 10 supplies air to the lines 14 and 16, one in which air from the lines 14 and 16 is discharged to atmosphere and another in which air is trapped in the lines 14 and 16. In the condition of the parts as appearing in FIG. 3, the valve 12 is in a nonsupply position and the piston 26 is in such position that both the charge port 40 and discharge port 54 are open. The reservoir 22 is empty of compressed air.

When the valve 12 is moved to its supply position, with the compressor 10 running, the air delivered forces the piston 26 to move (here upwardly) to cover the discharge port 54 so that no air flows to the container 24. It should be observed that the diameter of the passage 30 is quite small compared to the area of the bottom face of the piston 26, so that the piston moves as aforesaid and is retained in that position while air flows through the passage 30 and through the charge port 40 to accumulate in the reservoir 22. The valve 12 traps air in the lines 14 and 16 and also below the piston 26 so that the piston remains in position to cover or block the discharge port 54. Air under pressure is thus stored in the reservoir until needed.

When an occasion arises involving the need for releasing a "jam" in the container 24, the valve 12 is operated to release, or to discharge to atmosphere, and the trapped air in the lines 14 and 16 and beneath the piston is quickly vented, followed immediately by return of the piston 26 to its FIG. 3 position and an "explosive" rush of air from the reservoir via the ports 40 and 54 into the container.

As explained in the above-identified Matson patent, the process is repeated as often as is necessary, which is a relatively simple operation when the valve 12 (or several valves when used) is operated remotely, by timers, sequence switches, etc.

The simple connections available by the flange mountings afford great flexibility in mounting and dismounting of the unit or units 20 for replacement, repair, use elsewhere etc. The parts may be easily fabricated from available tubular stock welded together in suitable configurations, that shown here being representative.

Figure 7:
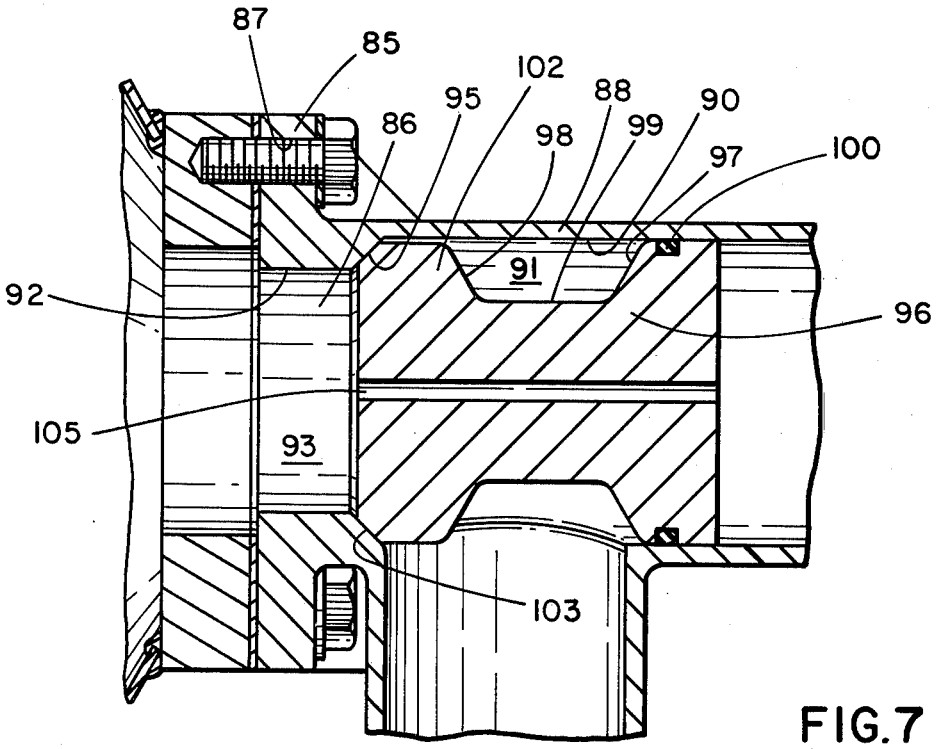
FIG. 7 is a sectional view of a modified embodiment of a portion of the structure shown in FIG. 3.

FIGS. 6 and 7 illustrate slightly modified forms of the piston and body arrangement. Both of these embodiments function in substantially the same manner as the embodiment illustrated in FIG. 3 the operation of which has been described.

In the embodiment of FIG. 6 an annular flange 62 is shown which is connected to a reservoir 22 (not shown). The flange 62 defines a central opening 64 in communication with the reservoir. The flange 62 includes a circular recess 65 surrounding the opening 64. A flange 66 is disposed radially to the axis of the body 67 and is welded to the body in surrounding relation to a charge port 68. An annular insert 70 is shown including a radial flange section 71 adapted to be removably secured between the flanges 62 and 66 and a tapered seat section 72 which extends downwardly into the charge end 73. A gasket 75 is disposed between the flanges 62 and 66 which are secured together by a plurality of circumferentially arranged bolts 76.

A piston or piston valve 77 of any suitable material is shown slidably disposed in the body. The piston carries an air-tight seal 78 such as for example an "O" ring. The piston also includes a central passage 80 running end-to-end therethrough adapted to communicate fluid pressure from the inlet to the reservoir. The piston also includes a flat end section 81 and a tapered seating section 82 which is adapted to sealingly engage the tapered seat section 72 of the insert 70 when the piston is in its charge position blocking the discharge port 54. One important advantage of this arrangement is that when the seat section 72 wears such that the sealing engagement with the piston becomes impaired, the entire insert 70 may simply be removed and replaced. This is particularly beneficial when the aerator is operating in a corrosive environment which tends to accelerate wear of the seat.

FIG. 7 illustrates a piston and housing arrangement wherein the piston seat and stop is integral with the housing. An annular flange 85 is provided with a central opening 86 adapted for communication with the reservoir, not shown. The flange 85 is adapted to be secured to a mating flange on the reservoir by a plurality of circumferentially arranged bolts extending through apertures 87. The body 88 includes a side wall 90 which defines a first chamber 91. The opening 86 includes a side wall 92 which defines a second chamber 93 having a smaller diameter than the chamber 91. A tapered wall section 95 extends between side walls 90 and 92 and serves as a seat for the piston.

A piston 96 is shown in the form of a spool valve slidably disposed in chamber 91. The piston includes a first land section 97 and a second land section 98 joined by a spool section 99. The piston may be made of any suitable material such as polyurethane plastic or the like. The land section 97 has an outer diameter slightly larger than the outer diameter of the land section 98. An air-tight seal 100 is carried by the land section 97 and sealingly engages the wall 90 to prevent the passage of air therebetween. The land 98 includes a flat end section 102 and a tapered seating section 103 which is adapted to sealingly engage the tapered wall-section 95 when the piston is in its charge position as illustrated in FIG. 7. The piston also includes a central passage 105 running end-to-end therethrough adapted to communicate air under pressure from the inlet to the reservoir. The body 88 must be slightly modified at the inlet end such that the circular plate 32 is removable to allow for insertion of the piston 96. One important advantage of this arrangement is that the piston stop and seating arrangement are integral with the housing reducing the number of parts for assembly.

What is claimed is:

1. A quick release aeration system including a pressure source; a gravity discharge container for flowable materials; an aerator including a hollow body having an inlet port at one end connected to said pressure source, a charge port at said other end, a tapered seating surface defined by said body internal thereto adjacent said charge port and a side discharge port disposed between said inlet port and said charge port and connected to said gravity discharge container, a unitary piston slidably disposed in said hollow body said piston defining a passage therethrough and said piston defining a tapered seating surface on one end threof adapted to mate with said tapered seating surface of said hollow body; an air reservoir connected to said charge port for storing air at increasing pressures; valve means associated with said pressure source and said inlet port and adapted in one position to pressurize said inlet port and in another position to release pressure from said inlet port, whereby when said inlet port is pressurized said piston assumes a first position blocking communication between said side discharge port and said charge port and allowing air to pass from said inlet port through said passage in said piston to said reservoir and when said inlet port is depressurized said piston instantaneously moves to a second position allowing communication between said charge port and said side discharge port to allow a rush of pressurized air from said reservoir through said side discharge port to said container of flowable material.

2. A quick release aeration system as in claim 1 in which said piston comprises a spool valve including a first land section, a second land section of lesser diameter than said first land section and a spool section connecting said first and second land sections.

* * * * *